US009993834B2

(12) United States Patent
Fleisch et al.

(10) Patent No.: US 9,993,834 B2
(45) Date of Patent: Jun. 12, 2018

(54) CHANGEOVER DEVICE FOR COATING MEDIA AND COATING SYSTEM FOR COATING OBJECTS

(71) Applicant: Eisenmann SE, Boeblingen (DE)

(72) Inventors: Juergen Fleisch, Lauffen am Neckar (DE); Tobias Mozer, Weil im Schoenbuch (DE)

(73) Assignee: EISENMANN SE, Boeblingen (DE)

( * ) Notice: Subject to any disclaimer, the term of this patent is extended or adjusted under 35 U.S.C. 154(b) by 119 days.

(21) Appl. No.: 14/888,799

(22) PCT Filed: Apr. 25, 2014

(86) PCT No.: PCT/EP2014/001115
§ 371 (c)(1),
(2) Date: Nov. 3, 2015

(87) PCT Pub. No.: WO2014/177261
PCT Pub. Date: Nov. 6, 2014

(65) Prior Publication Data

US 2016/0082459 A1 Mar. 24, 2016

(30) Foreign Application Priority Data

May 3, 2013 (DE) ..... 10 2013 007 694

(51) Int. Cl.
*B05B 12/14* (2006.01)
*B05B 7/24* (2006.01)

(52) U.S. Cl.
CPC ..... *B05B 12/1481* (2013.01); *B05B 7/24* (2013.01); *B05B 12/149* (2013.01)

(58) Field of Classification Search
CPC ..... B01B 1/16; B01B 1/1609; B01B 1/1618; B01B 1/1627; B05B 1/3013; B05B 1/3026; B05B 1/3046
See application file for complete search history.

(56) References Cited

U.S. PATENT DOCUMENTS

| | | | | |
|---|---|---|---|---|
| 6,090,450 | A | 7/2000 | Kahmann et al. | |
| 2003/0015607 | A1 | 1/2003 | Ehinger et al. | |
| 2012/0175432 | A1 * | 7/2012 | Milojevic | B05B 12/1481 239/329 |

FOREIGN PATENT DOCUMENTS

| | | | |
|---|---|---|---|
| DE | 198 05 938 | A1 | 8/1999 |
| DE | 198 30 029 | A1 | 1/2000 |

(Continued)

*Primary Examiner* — Karl Kurple
(74) *Attorney, Agent, or Firm* — Schroeder Intellectual Property Law Group, LLC

(57) ABSTRACT

The invention relates to a changeover device for coating media having a plurality of supply units, each of which has at least one inlet, which can be connected to a reservoir, and an outlet, wherein a flow channel extends between the inlet and the outlet. At least one coupling unit which can be moved relative to the supply units has an entry and an exit which can be connected to an application device, wherein a through channel extends between the entry and the exit. The entry of the coupling unit is complementary to the outlets of the supply units so that the entrance of the coupling unit can be coupled to the outlet of one of the supply units and can be separated again therefrom. The coupling unit is designed as a pigging station. The invention further relates to a coating system for coating objects having such a changeover device.

6 Claims, 9 Drawing Sheets

(56) References Cited

FOREIGN PATENT DOCUMENTS

| | | | |
|---|---|---|---|
| DE | 199 62 220 | A1 | 7/2001 |
| DE | 201 22 759 | U1 | 8/2007 |
| EP | 0 904 848 | A1 | 3/1999 |
| EP | 1 577 019 | A2 | 9/2005 |

* cited by examiner

CHANGEOVER DEVICE FOR COATING MEDIA AND COATING SYSTEM FOR COATING OBJECTS

RELATED APPLICATIONS

This application is a national phase of International Patent Application No. PCT/EP2014/001115, filed Apr. 25, 2014, which claims the filing benefit of German Patent Application No. 10 2013 007 694.3, filed May 3, 2013—the contents of both of which are incorporated herein by reference.

FIELD OF THE INVENTION

The invention relates to a changeover device for coating media, in particular for paints, having a) a plurality of supply units, each of which has at least one inlet, which is connectable to a reservoir, and an outlet, between which a flow duct extends;

b) at least one coupling unit, which is movable relative to the supply units and has an entrance and an exit connectable to an application device, between which a through-duct extends;

c) the entrance of the coupling unit being complementary to the outlets of the supply units in such a way that the entrance of the coupling unit is couplable to the outlet of one of the supply units and separable therefrom again.

Furthermore, the invention relates to a coating system for coating objects having a) an application device;

b) a plurality of reservoirs for respectively one coating medium;

c) at least one changeover device having a plurality of inlets, each of which is connected to its own reservoir for coating medium, and at least one exit, which is connected to the application device, and through which selectively a coating medium is conductible from a reservoir to the application device.

BACKGROUND OF THE INVENTION

A changeover device of this kind and a coating system of this kind are known, for example, from DE 201 22 759 U1.

For example, in the case of a painting plant a changeover device for coating media, i.e. then a colour-changeover device, is employed when in normal operation it relatively frequently occurs that for the coating of an object a different paint is to be used than the paint with which a previous object was painted.

In the case of a colour change, the previously used paint has to be cleaned from the media-conducting ducts and lines, for which purpose a flushing agent is conveyed through the corresponding ducts and lines. In order to keep paint losses and the required quantities of flushing agent as low as possible, the so-called pigging technique is often employed, in which the coating media or the flushing agent are pushed through the ducts and lines with the aid of pigs. In doing so, the pig is pushed to and from between two pig stations, of which one is arranged close to the application device and the other close to the changeover device.

Overall, in such and also in other known systems, the volume of the media-conducting ducts and lines from which a coating medium or flushing agent cannot be recovered is comparatively large. In particular, the volume in the changeover device is considerable.

The object of the invention is to provide a changeover device and a coating system of the kind mentioned at the outset which take account of these concerns.

This object is achieved in the case of a changeover device of the kind mentioned at the outset in that d) the coupling unit is formed as a pig station.

SUMMARY OF THE INVENTION

The invention is based on the insight that the coupling unit of the device can be designed as a pig station. In this way, there is no dead volume between the changeover device and the pig station associated therewith, from which no paint can be recovered, and the recoverable paint volume increases accordingly.

It has proved to be particularly favourable in this regard when a section of the through-duct of the coupling unit defines a pig space, in which medium can flow past a pig situated in the pig space and at least regionally along it as it does so. A more complex construction in which medium is led past the pig with the aid of valves can then be omitted. At the same time, a cleaning of the pig, which is absolutely essential before a colour change, is possible in a simple way since the pig in the pig space can also be flushed by flushing agent flowing around and over it.

Preferably, the through-duct is symmetrically widened in the section which defines the pig space. A substantially uniform flow around the pig can thus be realised.

It is advantageous when blocking means are present in the coupling unit, which prevent a movement of a pig out of the pig space in the direction of the entrance of the coupling unit. Thus, during a colour change and the operations associated therewith, the pig can be held in a parked position when media are carried away in the direction of the respectively connected supply unit.

In this case, it is favourable when the blocking means are formed by at least one abutment element which is arranged in the through-duct and against which a pig can abut at an end face.

Preferably, the abutment element comprises at least one abutment lance with a tip which is arranged in such a way that a pig can abut at its end face against the tip of the abutment lance. The contact region between pig and abutment element can thus be kept small, which in turn facilitates the pig cleaning.

It is furthermore advantageous when holding means are formed in the pig space, which hold a pig in a position axially parallel or coaxial to the through-duct. Preferably, the holding means are formed by at least one guide rib which runs on the inner wall of the pig space.

When paint is forced out of the supply unit to the application device and the pig is to move, owing to a pushing action by this paint, in the direction of the application device, it may happen that initially in the pig space a quantity of paint flows past the pig and is then pushed in front of the pig. If this is undesired, it is favourable when an initial drive device not formed by a coating medium or flushing medium is present, by which a pig situated in the pig space is pushable in the direction of the exit of the coupling unit.

In particular, the initial drive device can exert a fluidic force, for example by compressed air, or a mechanical force, for example by a piston element, on the pig.

With regard to the coating system, the above-stated object is achieved in that d) the changeover device is a changeover device having some or all of the above-mentioned features.

The advantages correspond here analogously to the advantages explained in each case regarding the changeover device.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with the aid of the drawings, in which.

DETAILED DESCRIPTION OF THE PRESENT INVENTION

Figure 1:
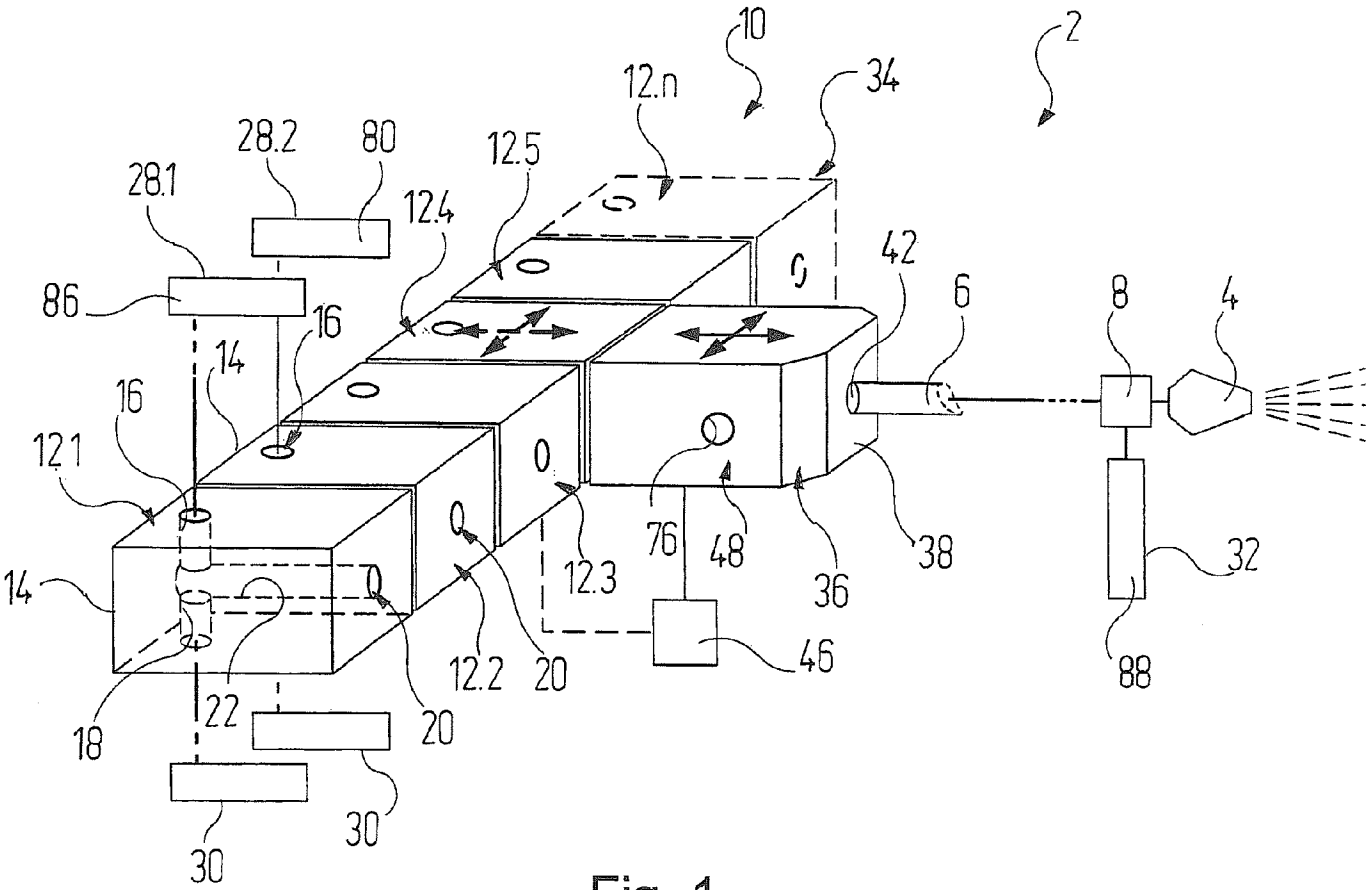
FIG. 1 shows a perspective view of a coating system having a first exemplary embodiment of a changeover device having a plurality of supply units and a coupling unit having a fluidic initial drive device which is connected via a piggable line to an application device and is formed as a pig station having a pig space.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
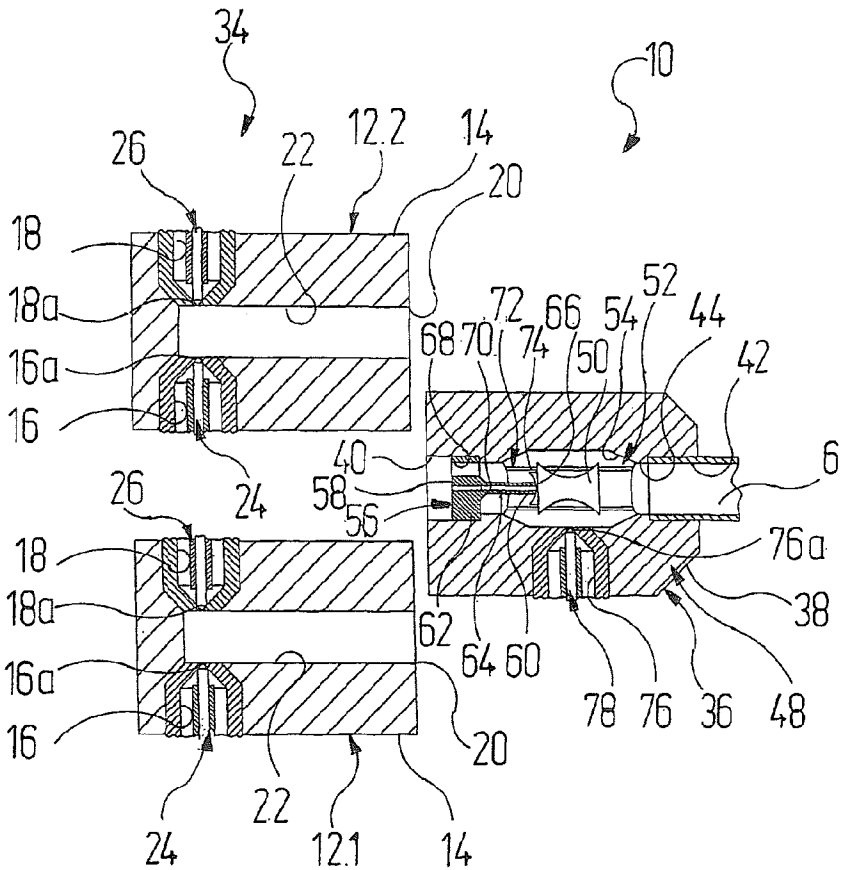
FIG. 2 shows a section of the changeover device of FIG. 1 during a change of the coupling unit from one supply unit to the next, a pig being situated in the pig space of the coupling unit.

Firstly, reference is made to FIGS. 1 and 2. A coating system for applying coating media is designated in FIG. 1, as a whole, by 2, which system comprises an application device 4. In the present case, by way of example, a coating system 2 for paints is described. In this case, the application device may, for example, be a spray gun or a high-speed rotary atomiser, as is known per se.

When a connection of ports, ducts or lines is mentioned hereinafter, primarily this means respectively a fluidic connection of such components, whereby corresponding flow paths are formed. Terms such as inlet, outlet, entrance or exit, used hereinafter, relate merely to a flow of medium in the direction of the application device. As will become clear below, however, medium may also flow in the other direction and in doing so flow out through an inlet or entrance or flow in through an outlet or exit.

The application device 4 is fed via a line 6. The coating system 2 is operated in a manner known per se using the pigging technique, which is why a pig station 8 is arranged in close proximity to the application device 4 in the line 6. At the end remote from the application device 4, the line 6 is connected to a changeover device 10 for coating media, which is thus a colour changeover device in the case of a coating with paint.

The changeover device 10 comprises a plurality of supply units 12, five supply units 12.1, 12.2, 12.3, 12.4 and 12.5 being shown in FIG. 1. The changeover device 10 comprises at least two and may also comprise more than five such supply units 12, the latter being illustrated in FIG. 1 by a supply unit shown dashed and designated by **12.*n*. The supply units 12 are of identical design; in FIG. 1, only the supply units 12.1 and 12.2** are provided with further reference symbols.

A supply unit 12 comprises a housing 14 which can be formed, for example, as a housing block. The housing 14 has an inlet 16 for coating medium, which is referred to below as paint inlet 16. In addition, the housing 14 has a flushing duct 18 and an outlet 20. The paint inlet 16 and the flushing duct 18 open via a respective valve seat **16*a* and 18*a* into a flow duct 22 which leads to the outlet 20, as can be seen in FIG. 2, in which only the two supply units 12.1 and 12.2 of the changeover device 10 are shown. For better illustration, these are arranged compared with FIG. 1 spaced further apart from one another and rotated by 90° with respect to their longitudinal axis, so that the respective inlets 16 and ducts 18** lie in the plane of the paper.

The paint inlet 16 and the flushing duct 18 of a supply unit 12 can each be closed or opened separately by a corresponding paint valve 24 and flushing valve 26. The valves 24, 26 can be seen in FIGS. 2 to 8 and are illustrated there as needle valves, known per se, which cooperate respectively with the valve seat **16*a*, 18*a* of the paint inlet 16 and of the flushing duct 18**.

The paint inlets 16 of the individual supply units 12 are respectively connected to their own paint reservoir 28, this being illustrated only in FIG. 1, where also only two such paint reservoirs 28.1 and 28.2 are shown, for the sake of clarity. Different paints, generally therefore different coating materials, are held ready in the respective paint reservoirs 28 associated with a particular supply unit 12.

The flushing ducts 18 of the individual supply units 12 are respectively connected to a collecting tank 30. A plurality of supply units 12 can also be connected to one and the same collecting tank 30. A flushing-agent reservoir 32 is connected to the pig station 8 at the application device 4.

By reservoir there is understood in the present case any technical solution for making available different media. This therefore also includes, for example, ring line systems, as are known per se.

The individual supply units 12 are put together and fastened to one another in a linear arrangement to form a supply module 34, via which the application device 4 can be supplied with a corresponding number of different paints.

In order to conduct a paint from one of the supply units 12 to the application device 4, the changeover device 10 comprises a coupling unit 36, by means of which the supply units 12 can be coupled to the application device 4.

The coupling unit 36 for its part comprises a housing 38 which can be formed, by way of example, likewise as a housing block. As can be seen from FIG. 2, the housing 38 has an entrance 40 and an exit 42, between which a through-duct 44 extends. The exit 42 is connected to the line 6 which leads to the application device 4 and to the pig station 8. The exit 42 of the coupling device 36 consequently forms at the same time the exit of the changeover device 10.

The entrance 40 of the coupling unit 36 is complementary to the outlets 20 of the supply units 12 in such a way that the entrance 40 of the coupling unit 36 is couplable to the outlet 20 of one of the supply units 12 and separable again therefrom. Suitable connecting flanges and connecting pieces or coupling systems which enable such a repeatable, leak-tight and detachable connection of media-conducting lines are known per se and not shown specifically in the present case.

The supply units 12 and the coupling unit 36 can be moved relative to one another. For this purpose, the changing unit 10 comprises a drive device 46, shown in FIG. 1, with the aid of which in the present exemplary embodiment the coupling unit 36 can be moved along the supply module 34 and coupled to a predetermined supply unit 12 or separated therefrom again. This is indicated in FIG. 1 by a crossed double-headed arrow.

Alternatively, in a modification, the supply units 12 can also be moved relative to the stationary coupling unit 36. This is illustrated by a dashed connection of the drive device 46 to the supply module 34 and a, likewise dashed, crossed double-headed arrow.

The coupling unit 36 is formed as a pig station 48, in which a pig 50 can be parked, as shown in FIG. 2. In the present exemplary embodiment, the through-duct 44 of the coupling unit widens in a section 52 symmetrically to form a pig space 54, so that medium can flow past a pig 50, situated in the pig space 54, and along it as it does so.

In order to prevent the pig 50 from moving out of the pig space in the direction of the entrance 40 of the coupling unit 36, blocking means 56 are present, which prevent such a movement of the pig 50. In the present exemplary embodiment, these blocking means 56 are formed as an abutment element 58 which is arranged in the through-duct 44 and against which the pig 50 can abut at an end face 60.

The abutment element 58 comprises a holding base 62, from which an abutment lance 64 with a free tip 66 coaxially projects. The abutment element 58 is anchored by its holding base 62 in the through-duct 44 between the entrance 40 and the pig space 54 such that the abutment lance 64 projects into the pig space 54. The holding base 62 has a plurality of through-ducts 68 in the axial direction, which are arranged radially beside the abutment lance 64, so that medium can flow through the abutment element 58.

A further, central duct 70 extends coaxially through the holding base 62 and the abutment lance 64 and ends in the tip 66 thereof.

In order to enable the pig 50 in the pig space 54 to be flushed well by medium flowing around it, holding means 72 are formed there which hold the pig in a position axially-parallel or coaxial to the through-duct 44. In the present exemplary embodiment, a plurality of guide ribs 74 running on the inner wall of the pig space 54 are provided for this. A pig 50 of wasted form in customary fashion, as shown in the figures, touches the guide ribs 74 only with a small part of its outer surface.

The coupling unit 36 additionally has an access 76 which opens via a valve seat **76*a* into the pig space 54 and can be closed or opened by a stop valve 78. The stop valve 78 is again formed as a needle valve and cooperates with the valve seat 76*a* at the pig space 54**.

The functioning of the coating system 2 having the changeover device 10 is now explained with the aid of FIGS. 2 to 7. In FIGS. 3 to 7 also, only the two supply units 12.1 and 12.2 of the changeover device 10 are shown; there too, not all components are provided with reference symbols, for the sake of simplicity.

FIG. 2 shows a starting situation in which the paint valves 24 and flushing valves 26 of the supply units 12.1, 12.2 and the stop valve 78 of the coupling unit 36 close the respective flow paths and in all ducts there is only air. The pig 50 is situated in the pig space 54 of the coupling unit 36 and abuts, at its end face 60 facing the entrance 40 of the coupling unit 36, against the tip 66 of the abutment lance 64.

The coupling unit 36 is moved to the supply unit 12.2 and coupled to it. Then, as shown in FIG. 3, the paint valve 24 of the latter is opened and a first paint 80 with a first colour, which paint is illustrated by small circles, flows out of the associated paint reservoir 28.2 into the flow duct 22 of the supply unit 12.2.

To propel media and the pig 50 in the line system formed by the ducts and lines explained, media pressure of paint, flushing agent, air, $CO_2$, nitrogen and the like can be used, which are provided in a manner known per se. Components required therefor, such as media sources, lines, valves and ports, are not shown specifically in the figures for the sake of clarity.

Figure 4:
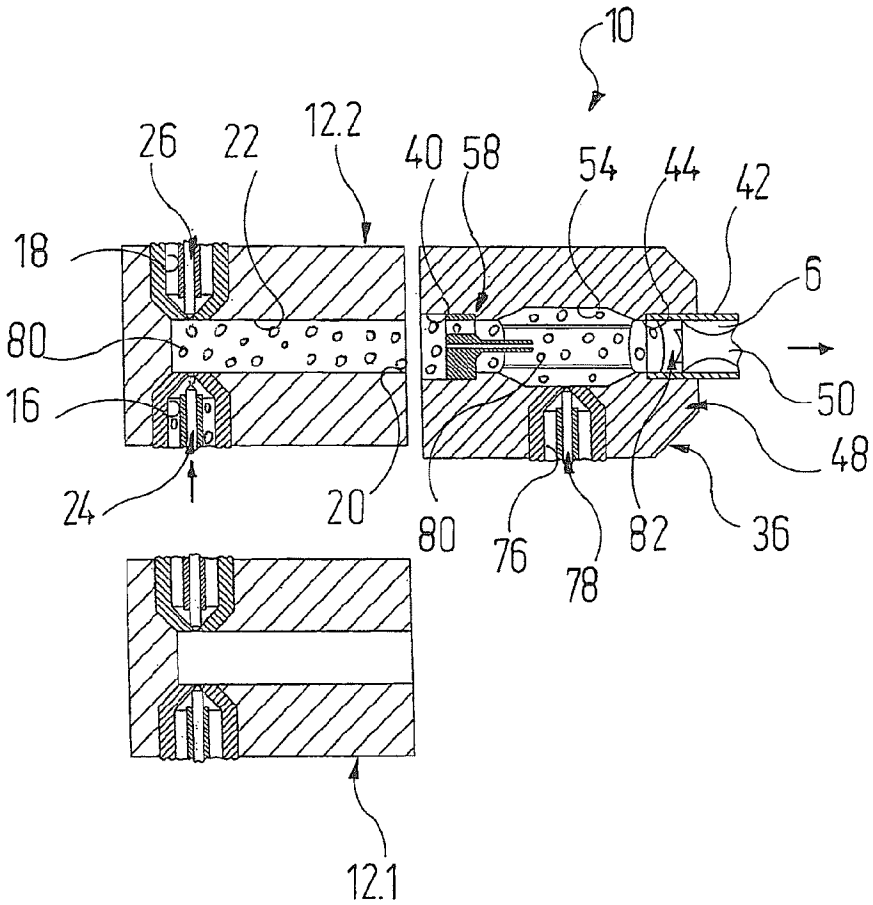

The paint 80 passes through the abutment element 58 into the pig space 54 and to the pig 50. Owing to impinging paint 80 the pig 50 moves to the exit 42 of the coupling unit 36 and there into the line 6, as shown in FIG. 4. An air cushion 82 may form between the paint 80 and the pig 50, but this is not troublesome. If such an air cushion 82 is to be prevented, the access 76 of the coupling unit 36 can be briefly opened by the stop valve 78 when the paint 80 penetrates into the pig space 54, so that air can firstly flow off to the outside until the paint 80 touches the pig 50.

Figure 3:
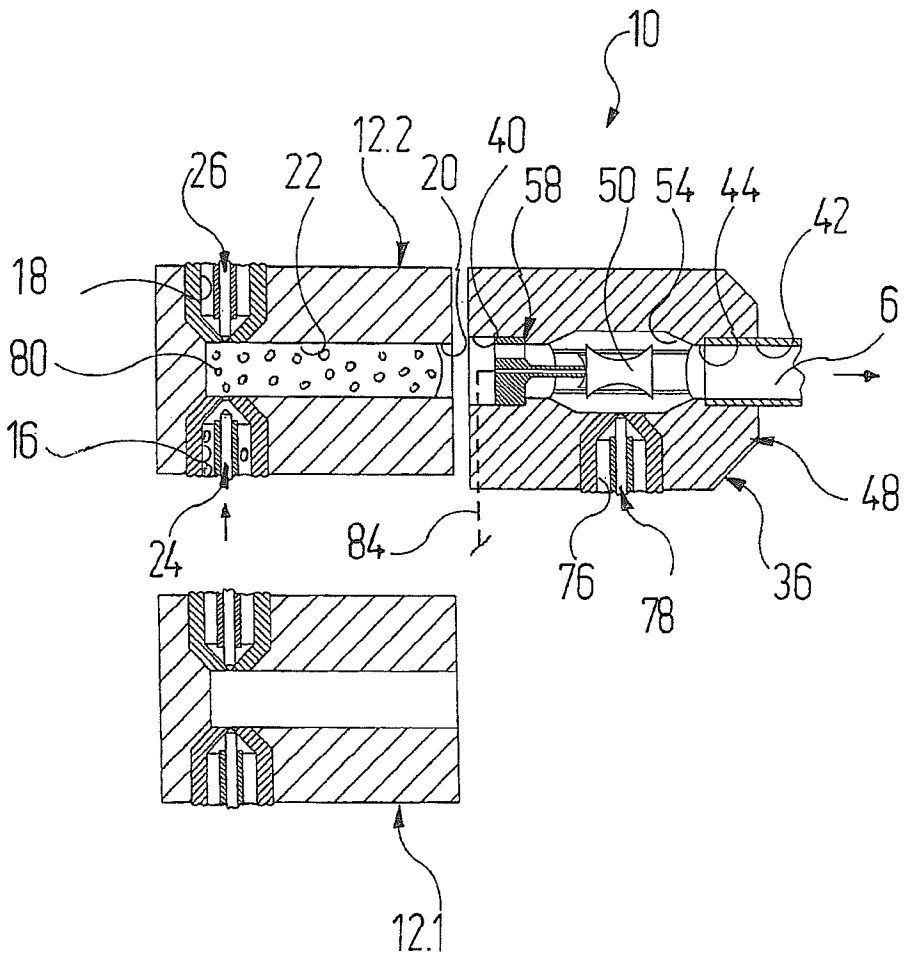
FIGS. 3 and 4 show a section of the changeover device at two instants of a forcing phase, in which paint is forced from a reservoir to the application device.

To assist the initial movement of the pig 50 away from the abutment element 58 in the direction of the exit 52 of the coupling unit 36, the central duct 70 can be acted upon by compressed air from a compressed air source 84, indicated only dashed in FIG. 3, which then flows out of the tip 66 of the abutment lance 64 onto the pig 50 and pushes the latter away from the abutment element 58. The duct 70 in the abutment element thus forms, together with the compressed air source 84, an initial drive device by which a pig 50 situated in the pig space 54 can be pushed in the direction of the exit 42 of the coupling unit 36 by exerting a fluidic force on it.

Figure 5:
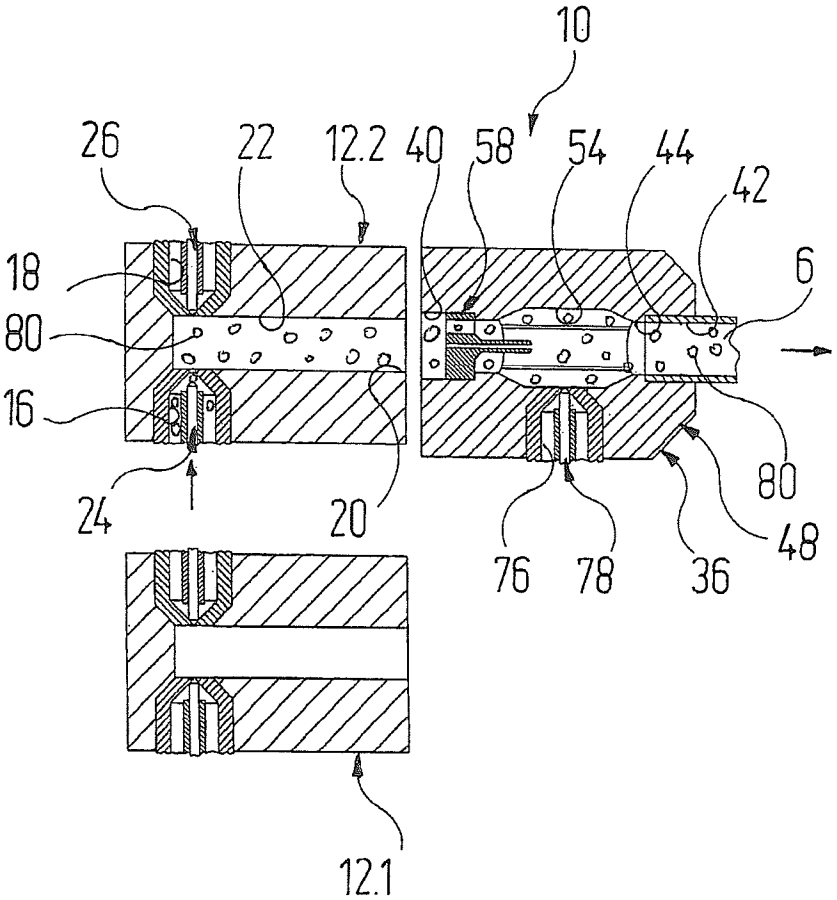
FIG. 5 shows a section of the changeover device in an application phase.

Now further paint 80 is conveyed from the associated reservoir 28.2 into the changeover device 10 and to the application device 4, until the pig 50 is received by the pig station 8 at the application device 4 and the paint can be applied. This is shown in FIG. 5, in which the pig 50 is accordingly no longer to be seen.

After completion of the application with the paint 80, a colour change to a second paint 86 with a different colour than the first paint 80 takes place, which here, by way of example, is kept ready in the reservoir 28.1 of the supply unit 12.1.

If now such a colour change is to be performed, firstly the first paint 80, which is situated in the line 6, the through-duct 44 of the coupling unit 36 and the flow duct 22 of the supply unit 12.2, is forced back into the reservoir 28.2 of the supply unit 12.2. For this purpose, the pig 50 is forced out of the pig station 8 by flushing agent 88 from the flushing-agent reservoir 32 at the application device 4—with the aid of a pressure medium, such as for example compressed air, which acts on the flushing agent—via the line 6 until it is in the pig space 54, the pig 50 pushing the paint 80 in front of it in the process. The flushing agent 88 is illustrated by small waves. The paint valve 24 of the supply unit 12.2 is open during this, whereby the paint 80 is pushed back into the paint reservoir 28.2. This is not shown in the figures.

Optionally the flushing medium may also be dispensed with. In this case the pig 50 is acted upon by compressed air directly and thus conducted through the line 6.

Figure 6:
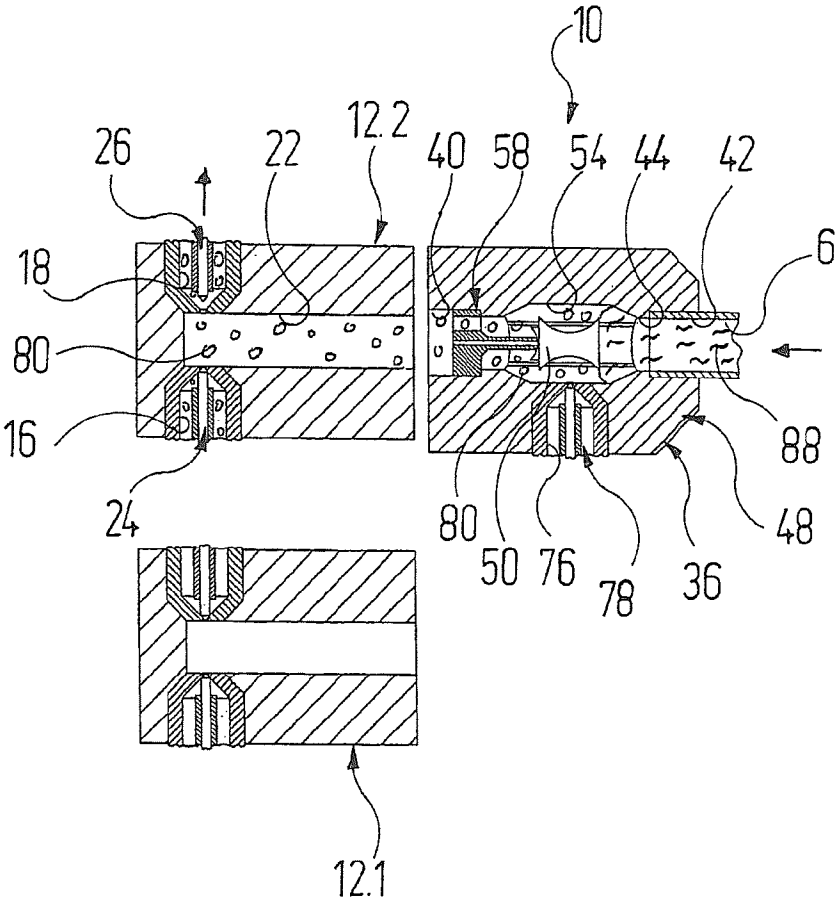
FIGS. 6 and 7 shows a section of the changeover device at two instants of a flushing phase, in which a paint fraction is carried away via a flushing duct.

The pig 50 is pushed in the pig space 54 up to the abutment element 58. When the pig 50 in the pig space 54 abuts against the abutment element 58 and is prevented from further movement to the entrance 40 of the coupling unit 36, the paint valve 24 of the supply unit 12.2 is closed and the flushing valve 26 of the latter opened. This configuration is shown in FIG. 6.

The presence or absence of the pig 50 in the pig space 54 or in the pig station 8 can be ascertained with the aid of established detection methods. Suitable for this are, in a known manner, for example proximity sensors, magnetic eddy probes, light barriers and light-guiding and ultrasonic techniques or a determination of the pig positions by pressure or quantity measurements based on the conveyed coating medium.

Figure 7:
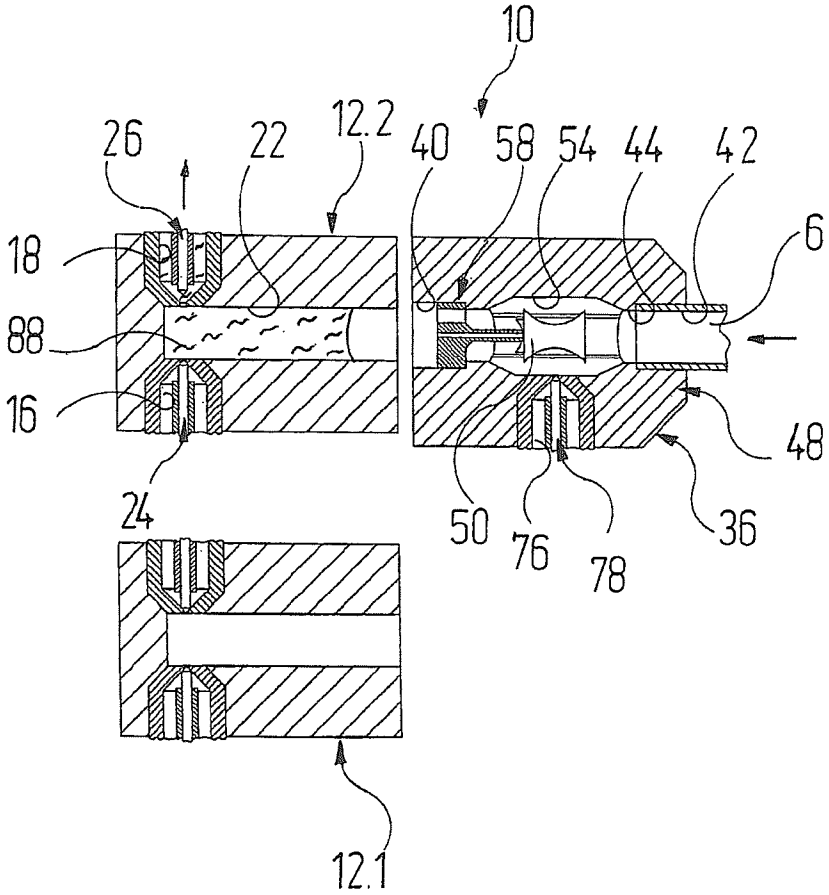

If now further flushing agent 88 is forced out of the flushing-agent reservoir 32, the paint 80 still present in the supply unit 12.2 and the coupling unit 36 is carried away through the flushing duct 18 into the collecting tank 30 until there is only flushing agent 88 left in the ducts. As shown in FIG. 7, this is then further forced out of the flushing duct 18 by air until there is only air left in the lines and ducts. The flushing agent 88, and subsequently the air, here flow over the pig 50 in the pig space 54, whereby the latter is freed from paint residues of the paint 80 and dried.

Then the flushing valve 26 is closed and the coupling unit 36 separated from the supply unit 12.2 by means of the drive device 46, this again corresponding to the configuration shown in FIG. 2. Now the coupling unit 35 is moved to the supply unit 12.1 and coupled to it and the above-described operations are performed on the supply unit 12.1, via which the paint 86 from the reservoir 24.1 can be applied.

Figure 8:
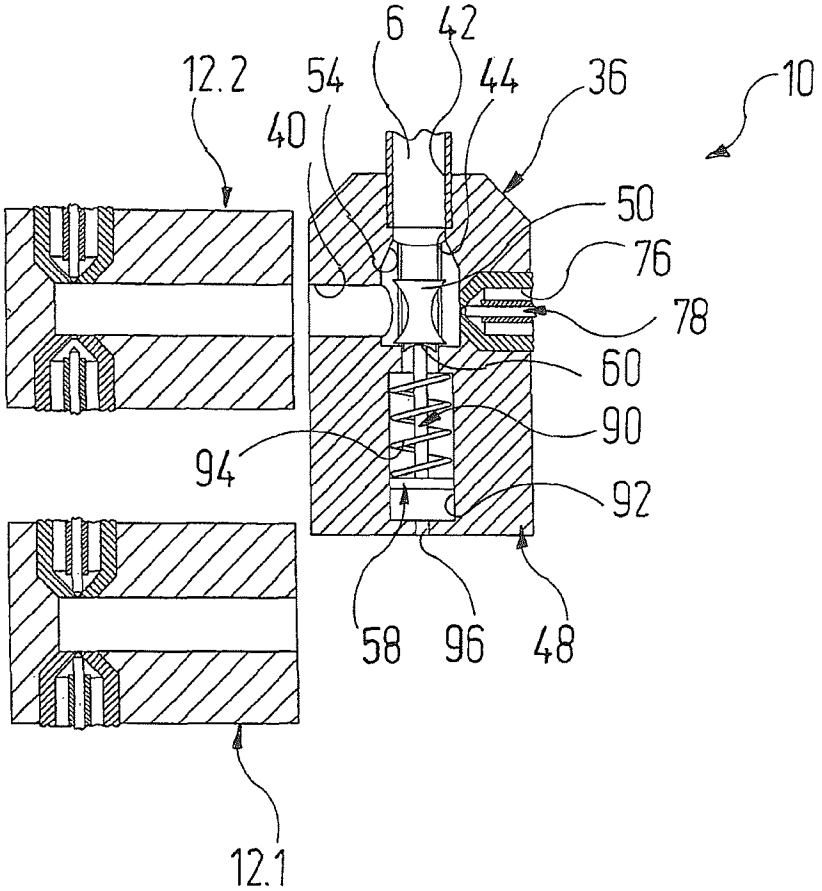
FIG. 8 shows a section of a second exemplary embodiment of the changeover device having a modified coupling unit having a mechanical initial drive device.

FIG. 8 shows, as the second exemplary embodiment, a changing unit 10 having a modified coupling unit 36. Components which have already been explained bear the same reference symbols there, and the supply units 12.1 and 12.2 are not provided with further reference symbols. In this embodiment the abutment element 58 is formed as a piston element 90 which is displaceable in a piston space 92 connected to the pig space 54 and is held, by a spring 94, in a position moved in relative to the pig space 54. In this position the pig 50 can abut with its end face 60 against the piston element 90, as shown in FIG. 8.

On the side of the piston element 90 remote from the pig space 54, this element can be acted upon by compressed air via a compressed-air connection 96 and pushed into the pig space 54 against the spring force of the spring 94. In this way, the initial movement of the pig 50 away from the abutment element 58 in the direction of the exit 52 of the coupling unit 36 is assisted by the piston element 90 by a mechanical force exertion when paint from a reservoir 28 reaches the pig space 54. Consequently, the piston element 90 here cooperates with the spring 94 and compressed air as the initial drive device.

Since the piston space 92 requires a suitable constructional space in the axial direction of the pig space 54, the through-duct 44 of the coupling unit 36 runs at a right angle such that the entrance 40 is arranged laterally beside the pig space 54.

Figure 9:
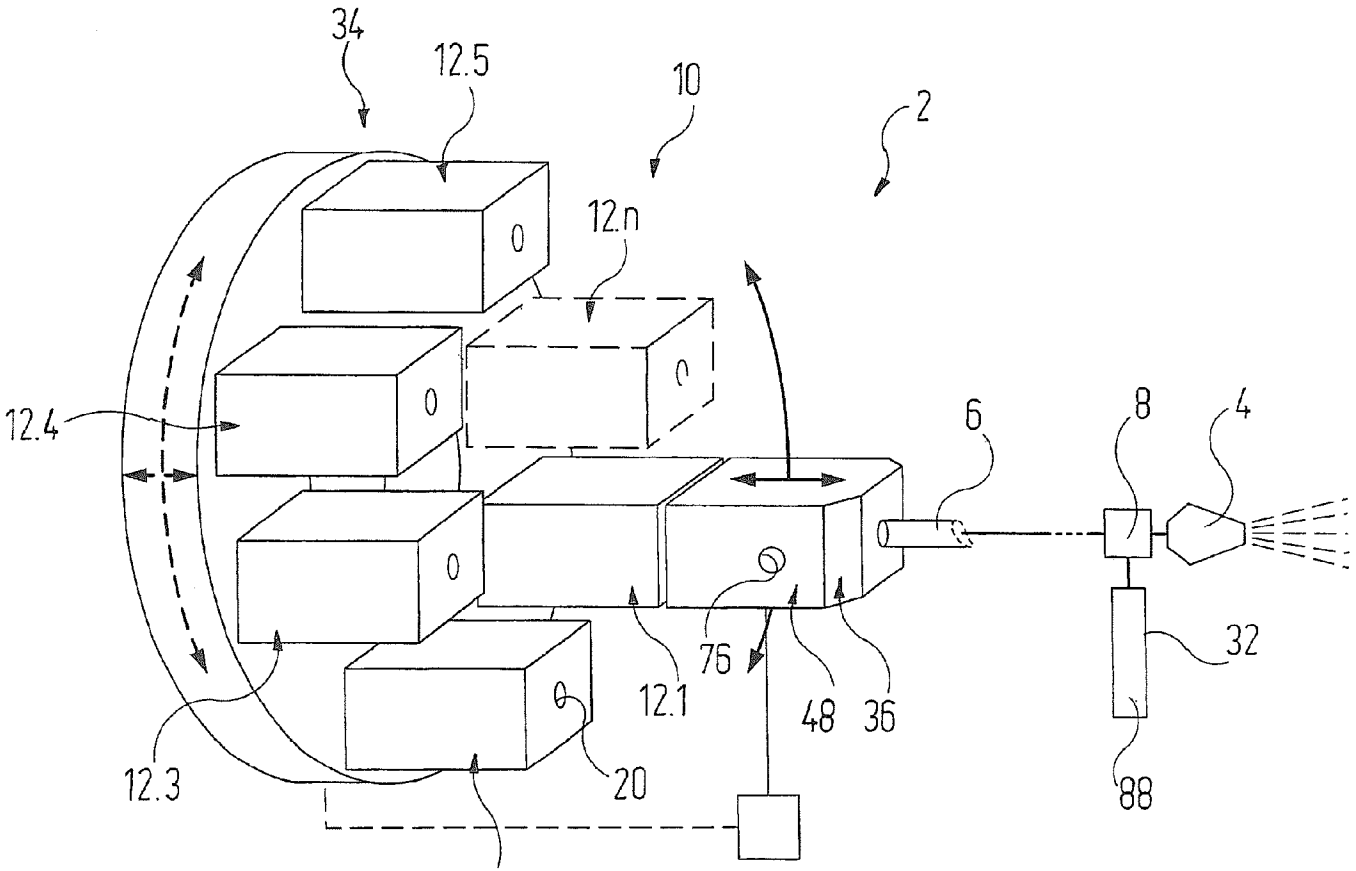
FIG. 9 shows a perspective view of a modified coating system having a third exemplary embodiment of a changeover device.

FIG. 9 shows a modified coating system 2 having a third exemplary embodiment of the changeover device 10. There the supply units 12 in the supply module 34 are circularly arranged, so that a kind of revolver drum is formed. The relative movement between the supply units 12 and the coupling unit 36 thus follows a circular path, apart from the coupling or separating movement of the units 12 and 36 concerned. This is illustrated again by corresponding crossed double-headed arrows.

Since the coupling unit 36 is formed as a pig station 48, the paint loss on a colour change can be kept overall very low and is limited, on the one hand, to the paint which is situated between the pig station 8 and the application device 4 and which is blown out via the application device 4, and, on the other hand, to the volume between the pig 50 in the pig space 54 and the flushing duct 18 of the respective supply unit 12. This amount of paint may decrease all the more as the distance between the application device 4 and the pig station 8 or the pig 50 and the flushing duct 18 decreases.

If required, the pig 50 in the pig space 54 can furthermore be cleaned separately, by forcing flushing agent through the access 76 into the pig space 54, which agent can then be carried away through the connected supply unit 12 into the collecting tank 30. In this case, as mentioned above, a supply of flushing agent via the pig station 8 into the line 6 can be dispensed with.

Two changeover devices 10 can also be operated in parallel in a coating system. Compared with a coating system 2 having only one changeover device 10, a colour change can then take place more quickly. While, for example, paint 80 from the reservoir 28.2 is being applied via a first changeover device 10, a second changeover device 10 and its supply line 6 as far as the pig station 8 can already be flushed. After this flushing operation, it is then already possible to supply the next paint, paint 86 from the reservoir 28.1, as far as the pig station 8. The section of the line 6 between the pig station 8 and the application device 4 can be flushed, on a colour change, with flushing agent from the flushing-agent reservoir 32 via the pig station 8.

Such a parallel or alternating operation of two changeover devices is known per se and therefore does not need to be explained further.

The pig station 8 at the application device 4 can be constructed, on the one hand, in a manner customary and known from the prior art. On the other hand, the pig station 8 can be formed in a similar manner to the coupling unit 36 and comprise a corresponding pig space in which medium can flow past the pig 50. Corresponding blocking means 56 in this case prevent a movement of the pig 50 in the direction of the application device 4 when the pig is in the pig space.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A changeover device for coating media comprising:

a) a plurality of supply units, each of which has at least one inlet, which is connectable to a reservoir, and an outlet, between which a flow duct extends;

b) at least one coupling unit, which is movable relative to the supply units and has an entrance and an exit connectable to an application device, between which a through-duct extends;

c) the entrance of the coupling unit being complementary to the outlets of the supply units in such a way that the entrance of the coupling unit is couplable to the outlet of one of the supply units and separable therefrom again, the coupling unit includes a coupling system to provide repeatable, leak-tight, and detachable connection with the outlet of each supply unit, wherein d) the coupling unit is formed as a pig station wherein a section of the through-duct of the coupling unit defines a pig space, the pig space configured to allow coating media to flow past a pig situated in the pig space and allowing flow of coating media along the pig when the pig is situated in said pig space; and e) the coupling unit is arranged in a line supplying coating media to the application device, wherein the exit of the coupling unit is connected to the line supplying coating media to the application device;

f) the coupling unit including an access which is configured to open via a valve seat, the access being configured to receive a flushing agent; and g) the coupling unit further comprising a means for blocking in the coupling unit, the means for blocking being configured to prevent a movement of the pig out of the pig space in a direction towards the entrance of the coupling unit.

2. The changeover device according to claim 1, wherein the through-duct is symmetrically widened in the section which defines the pig space.

3. The changeover device according to claim 1, wherein the means for blocking is an abutment element, the abutment element comprises at least one abutment lance with a tip which is arranged in such a way that a pig can abut at its end face against the tip of the abutment lance.

4. The changeover device according claim 1, wherein a holding means is formed in the pig space, which hold a pig in a position axially parallel or coaxial to the through-duct.

5. The changeover device according claim 1, wherein an initial drive device not formed by a coating medium or flushing medium is present, by which a pig situated in the pig space is pushable in the direction of the exit of the coupling unit.

6. The changeover device according to claim 5, wherein a fluidic force or a mechanical force is exertable on the pig by the initial drive device.

* * * * *